US009702206B2

(12) United States Patent
Angelle et al.

(10) Patent No.: US 9,702,206 B2
(45) **Date of Patent: *Jul. 11, 2017**

(54) SINGLE UPSET LANDING STRING RUNNING SYSTEM

(71) Applicant: Frank's International, LLC, Houston, TX (US)

(72) Inventors: Jeremy Richard Angelle, Youngsville, LA (US); Robert Thibodeaux, Jr., Lafayette, LA (US); Tyler J. Hollier, Broussard, LA (US)

(73) Assignee: Frank International, LLC, Houston, TX (US)

( * ) Notice: Subject to any disclaimer, the term of this patent is extended or adjusted under 35 U.S.C. 154(b) by 284 days.

This patent is subject to a terminal disclaimer.

(21) Appl. No.: 14/584,636

(22) Filed: Dec. 29, 2014

(65) Prior Publication Data

US 2015/0136413 A1 May 21, 2015

Related U.S. Application Data

(63) Continuation of application No. 13/459,314, filed on Apr. 30, 2012, now Pat. No. 8,919,429.

(60) Provisional application No. 61/481,216, filed on May 1, 2011.

(51) Int. Cl.

| | |
|---|---|
| ***E21B 19/06*** | (2006.01) |
| ***E21B 19/07*** | (2006.01) |
| ***E21B 19/10*** | (2006.01) |
| ***E21B 19/00*** | (2006.01) |

(52) U.S. Cl.

CPC ..... *E21B 19/004* (2013.01); *E21B 19/06* (2013.01); *E21B 19/07* (2013.01); *E21B 19/10* (2013.01)

(58) Field of Classification Search

CPC ..... E21B 19/004; E21B 19/06; E21B 19/07; E21B 19/10

See application file for complete search history.

(56) References Cited

U.S. PATENT DOCUMENTS

| | | | | |
|---|---|---|---|---|
| 4,275,488 | A | 6/1981 | Gray et al. | |
| 6,557,641 | B2 | 5/2003 | Sipos et al. | |
| 8,919,429 | B2 * | 12/2014 | Angelle | E21B 19/07 166/380 |

(Continued)

OTHER PUBLICATIONS

International Search Report and Written Opinion from PCT/US2012/035746 dated Nov. 1, 2012 (7 pages).

(Continued)

*Primary Examiner* — Brad Harcourt
(74) *Attorney, Agent, or Firm* — Osha Liang LLP

(57) ABSTRACT

Systems, apparatus, and methods for longitudinally moving or running a tubular, with the system including an elevator suspended from a rig. The elevator includes a body defining a bore to receive a tubular and wedges defining channels therebetween, with the wedges being configured to engage the tubular. The system may also include a spider including a body defining a bore to receive the tubular and wedges defining channels therebetween. The wedges of the spider may be configured to engage the tubular, and the wedges of the elevator may be configured to slide axially at least partially in the channels of the spider. The wedges of the spider may be configured to slide axially at least partially in the channels of the elevator.

16 Claims, 10 Drawing Sheets

(56) References Cited

U.S. PATENT DOCUMENTS

| | | | |
|---|---|---|---|
| 2005/0000696 | A1 | 1/2005 | McDaniel et al. |
| 2009/0056930 | A1 | 3/2009 | Angelle et al. |
| 2009/0057032 | A1 | 3/2009 | Angelle et al. |
| 2009/0252589 | A1 | 10/2009 | Sonneveld et al. |

OTHER PUBLICATIONS

Office Action issued in related U.S. Appl. No. 13/459,314 mailed May 23, 2014 (8 pages).
Notice of Allowance issued in related U.S. Appl. No. 13/459,314 mailed Aug. 26, 2014 (5 pages).
Office Action issued in related U.S. Appl. No. 13/898,260 mailed Apr. 8, 2015 (18 pages).
International Search Report and Written Opinion from PCT/US2012/035746 dated Nov. 12, 2012 (9 pages).

* cited by examiner

SINGLE UPSET LANDING STRING RUNNING SYSTEM

CROSS-REFERENCE TO RELATED APPLICATIONS

The present application claims priority as a continuation application from U.S. patent application Ser. No. 13/459,314, filed Apr. 30, 2012. The '314 Application claimed priority to U.S. Provisional Patent Application Ser. No. 61/481,216, filed May 1, 2011. The contents of both priority applications are hereby incorporated by reference in their entirety.

BACKGROUND

This application claims priority to U.S. Provisional Patent Application Ser. No. 61/481,216, which was filed May 1, 2011. This priority application is hereby incorporated by reference in its entirety into the present application, to the extent that it is not inconsistent with the present application.

In oilfield applications, for example, in deep-sea locations, heavy tubulars extend downward from the platform and may be supported by engagement with a landing string. Depending on the particular application (i.e., drilling, completion, etc.), the landing string may be provided by drill pipe or other high-tensile tubulars. Such landing strings are often required to support a heavy load, such that traditional running systems, which generally employ slips or bushings to hold the tubular by engaging the outer diameter thereof, are inadequate. Further, as offshore drilling operations continually push into deeper water, the tensile load transmission from the landing string to the rig continues to increase in order to support the increased string weight, which is increasingly causing "slip crushing," whereby the slips and/or bushings engage the tubular body with such force that the tubular body is crushed or otherwise damaged.

To avoid this, landing strings are typically lowered by engagement with an upset (i.e., a shoulder) on the tubular body of the landing string. One way to do this is to employ dual-upset tubulars, allowing the tubular to be lowered by engaging one upset with the elevator and the second with the spider. Another common method shuttles or circulates a pair of elevators to ensure that only the upset is engaged, thereby obviating the need for special dual-upset tubulars. The first elevator begins suspended by the bails, while the second elevator acts as a spider, resting on the rotary table and supporting the landing string by the upset of the upper-most tubular of the landing string (i.e., the most recently run-in segment). The first elevator engages a new tubular segment, positions it with the top drive, and the top drive makes it up to the exposed box of the landing string. The slips or bushings of the second elevator are then disengaged from the upset and the second elevator is removed; thus, the weight of the landing string is transmitted through the new tubular segment to the first elevator. The first elevator then lowers until it abuts the rotary table, and, as such, now acts as a spider. The bails are then switched to the second elevator, which engages another new tubular segment, and the process is repeated.

Such known processes have significant drawbacks, requiring special dual-upset tubulars or time-consuming switching of bails between elevators. What is needed are faster, more cost-effective methods and apparatus for lowering such heavy tubulars, while avoiding slip crushing.

SUMMARY

Embodiments of the disclosure may provide an exemplary tubular running system. The tubular running system may include an elevator suspended from a rig and including a body defining a bore to receive a tubular and wedges defining channels therebetween, with the wedges being configured to engage the tubular. The tubular running system may also include a spider including a body defining a bore to receive the tubular and wedges defining channels therebetween. The wedges of the spider may be configured to engage the tubular, and the wedges of the elevator may be configured to slide axially at least partially in the channels of the spider. The wedges of the spider may be configured to slide axially at least partially in the channels of the elevator.

Embodiments of the disclosure may also provide an exemplary method for running a tubular. The method may include engaging an upset of the tubular with an elevator, and moving the tubular by vertically moving the elevator. The method may also include engaging the upset of the tubular with a spider while still engaging the upset with the elevator, and disengaging the upset of the tubular from the elevator, such that the upset is supported by the spider.

Embodiments of the disclosure may further provide an exemplary apparatus for longitudinally moving a tubular. The apparatus may include a first tubular engagement device suspended from a rig and including a plurality of gripping assemblies spaced apart and defining first channels therebetween. The first gripping assemblies may be configured to engage at least an upset of the tubular to support the tubular. The apparatus may also include a second tubular engagement device including second gripping assemblies spaced circumferentially apart and defining second channels therebetween. The second gripping assemblies may be configured to engage at least the upset of the tubular to support the tubular. The second tubular engagement device may be configured to engage the upset while the first tubular engagement device is also in engagement with the upset.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
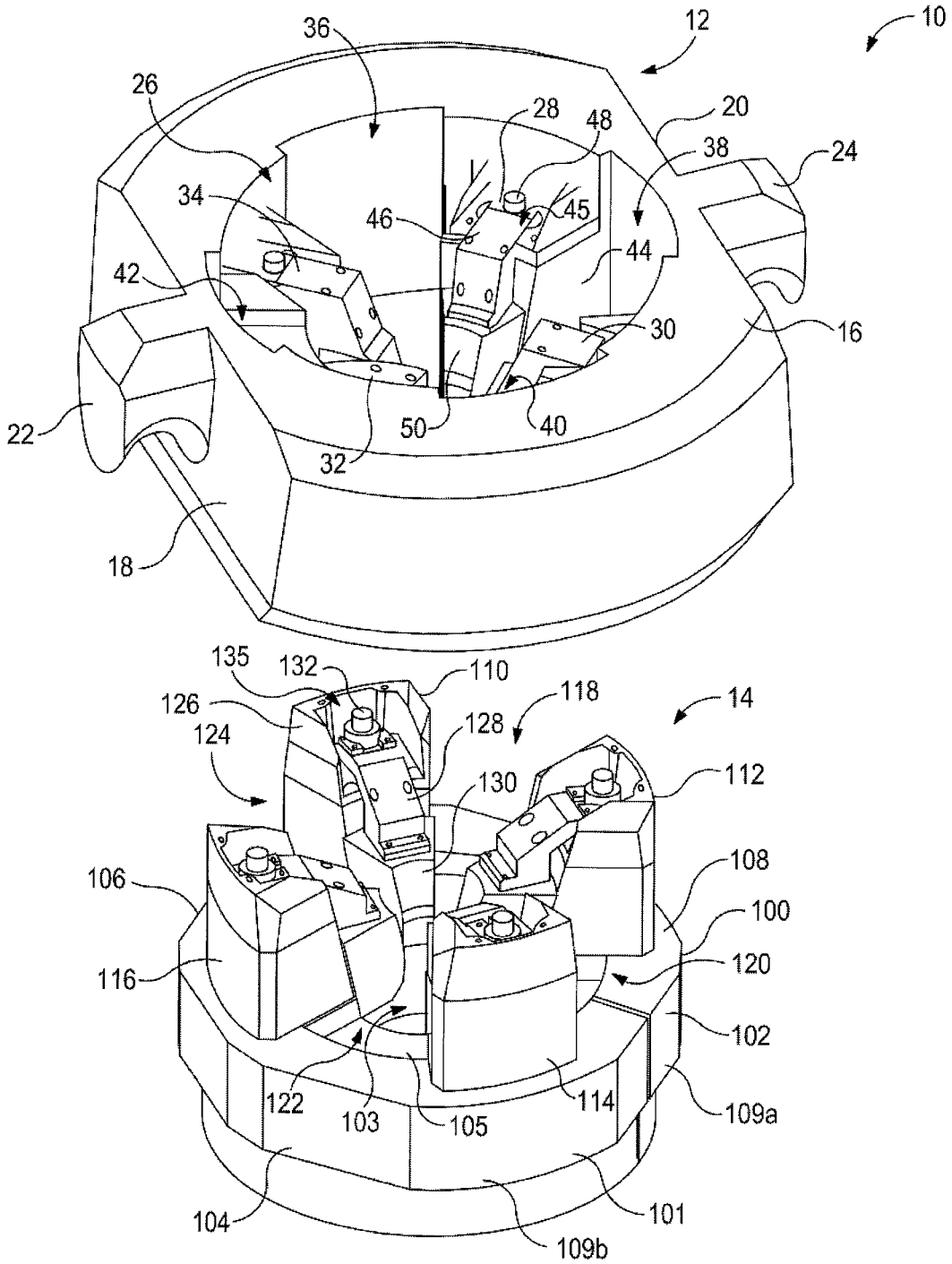
FIG. 1 illustrates a perspective view of an exemplary running system, according to an aspect of the disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a perspective view of an exemplary running system 10, according to an embodiment described. The exemplary running system 10 may be particularly useful for running landing strings; however, it will be appreciated that the running system 10 disclosed herein may be equally applicable to running, lowering, raising, making-up, breaking-out, or otherwise moving any type of tubulars for any purpose. The running system 10 generally includes first and second tubular engagement devices 12, 14. In at least one embodiment, the first tubular engagement device 12 is movable, and may be referred to as an elevator 12. The second tubular engagement device 14, on the other hand, may be stationary and may be referred to as a spider 14.

As shown, the elevator 12 includes a body 16, which may have a generally cylindrical shape and opposing flats 18, 20. Ears 22, 24 for engagement with bails (not shown) extend from the flats 18, 20, for example outward, such that the elevator 12 may be suspended from the rig (e.g., via a traveling block and/or top drive, not shown) and movable vertically toward or away from the spider 14. The body 16 defines a central bore 26 therethrough, in which gripping assemblies 28, 30, 32, 34 are positioned. As the term is used herein, "gripping assembly" is intended to be broadly defined to include any configuration of one or more slips, bushings, or any other device(s) used to engage a tubular, whether including teeth or not. Channels 36, 38, 40, 42 are defined by the bore 26, between adjacent gripping assemblies 28, 30, 32, 34.

As indicated for the gripping assembly 28, each of the gripping assemblies 28, 30, 32, 34 may generally include a tapered housing 44, a bracket 46, a piston 48, and a wedge 50. As the term is used herein, "wedge" is intended to be broadly defined to include slips, bushings, bushing segments, or any like structures capable of applying a gripping force to a tubular, whether including teeth or not. In the illustrated embodiment, the wedge 50 is free from teeth or other marking structures. The tapered housing 44 is generally positioned in the bore 26 and bears on the body 16; further, the tapered housing 44 may be integral with a remainder of the body 16 and/or may be coupled thereto. The tapered housing 44 is tapered such that it extends radially inward, proceeding downwards, and provides a channel 45 in which the bracket 46 and piston 48 are at least partially disposed. The bracket 46 is moved in the channel 45 by movement of the piston 48. In various embodiments, the piston 48 may be moved or articulated by a hydraulic assembly, as is well-known in the art. In other embodiments, the piston 48 may be driven by pneumatics, motors, springs, linkages, combinations thereof, or the like. Further, the bracket 46 may be configured to transmit longitudinal, for example, upward, force on the wedge 50, to disengage the wedge 50 from a tubular (not shown), as will be described in greater detail below. Although four gripping assemblies 28, 30, 32, 34 are shown, it will be appreciated that fewer or additional gripping assemblies, for example, two, three, five, six or more gripping assemblies, may be used without departing from the scope of the disclosure.

Turning to the spider 14, the spider 14 includes a body 100, which may be generally cylindrical in shape and may have an increased-radius shoulder 101 defining at least a portion of the top of the body 100. The shoulder 101 of the body 100 defines flats (three are visible: 102, 104, 106) on its outer diameter for engagement with various tools or other structures, as will be described in greater detail below. Further, the shoulder 101 may define a landing surface 108 on the upper side thereof. The body 100 may also define a bore 103 extending axially therethrough, for receiving a tubular (not shown). Proximal the top of the bore 103, the body 100 may define an annular seat 105, which is recessed from the landing surface 108.

In at least one embodiment, the body 100 may be split, as shown, defining two or more generally arc-shaped segments 109*a*, 109*b*. As will be described in greater detail below, the segments 109*a,b* may be held together by an interior surface defined in the rotary table (not shown), as is known in the art. In other embodiments, however, other structures such as a retaining collar or the like may be used to secure the position of the body 100. Additionally, in still other embodiments, the segments 109*a,b* may be coupled together via a hinge (not shown) or any other coupling mechanism.

Gripping assemblies (e.g., bushing or slip assemblies) 110, 112, 114, 116 may extend upward from the landing surface 108 and the seat 105 and inward from the bore 103. Channels 118, 120, 122, 124 are defined between adjacent gripping assemblies 110, 112, 114, 116. As indicated for the gripping assembly 110, each gripping assembly 110, 112, 114, 116 may include a tapered housing 126, a bracket 128, a wedge 130, and a piston 132. Further, the housing 126 provides a channel 135 therein for guiding longitudinal movement of the bracket 128. The bracket 128 is coupled to the wedge 130 and may be configured to transfer longitudinal force from the piston 132 to the wedge 130, for example, to raise or lower the wedge 130 into or out of engagement with a tubular (not shown). The piston 132 may be driven to move the bracket 128 by pneumatics, hydraulics, motors, mechanical linkages, springs, combinations thereof, or the like.

FIGS. 2-8 illustrate an exemplary operation of the running system 10, whereby a sequence of the elevator 12 engaging and moving a tubular 200, lowering the tubular 200 through the spider 14, transferring load to the spider 14, and disengaging from the tubular 200 is illustrated. It will be appreciated that this sequence may be reversed, or otherwise re-arranged without departing from the scope of this disclosure.

Figure 2:
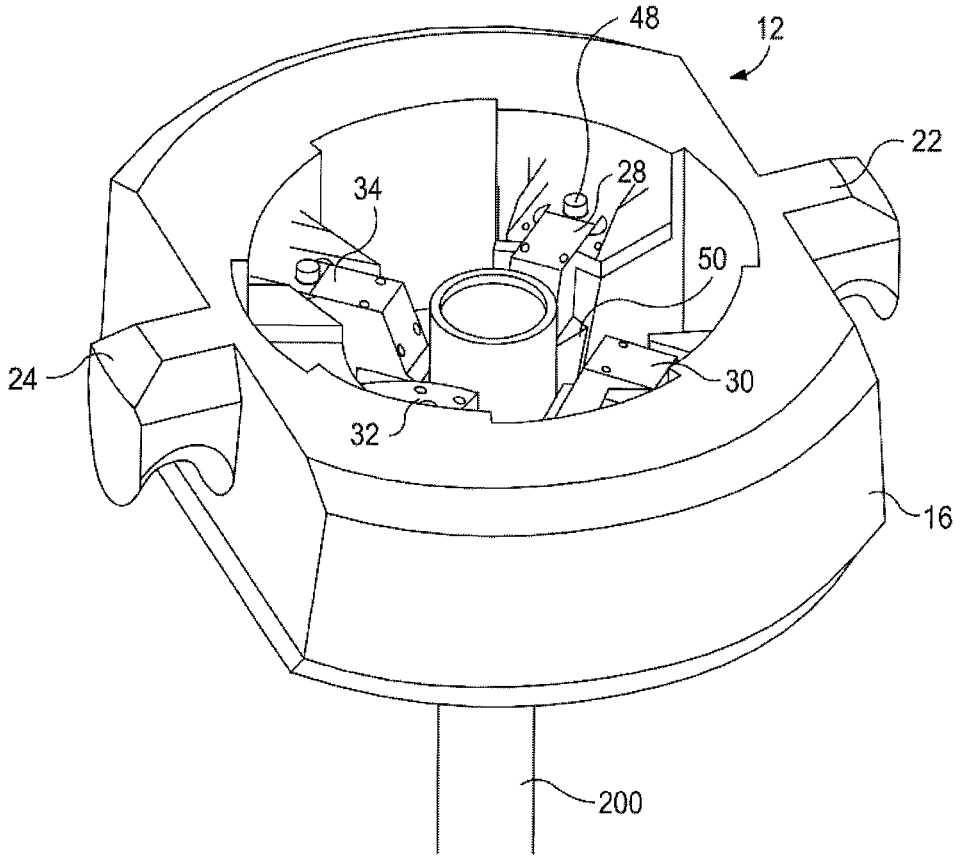
FIG. 2 illustrates a perspective view of an exemplary elevator engaging a tubular, according to an aspect of the disclosure.
Figure 3:
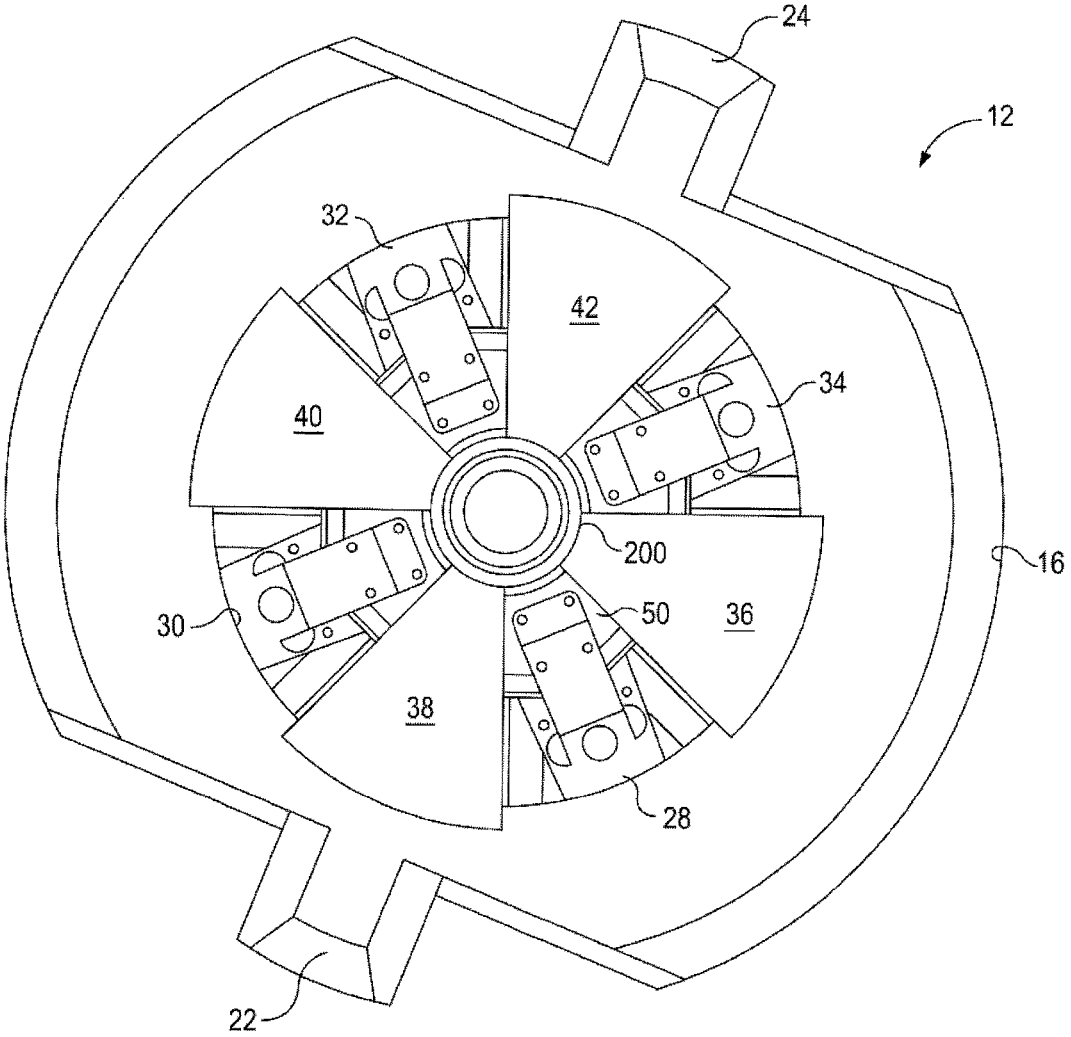
FIG. 3 illustrates a top view of the elevator of FIG. 2, according to an aspect of the disclosure.

Referring now specifically to FIGS. 2 and 3, there is illustrated a perspective view and a top view, respectively, of the elevator 12, according to an embodiment described. As shown, the gripping assemblies 28, 30, 32, 34, particularly the wedges 50 (FIG. 3) thereof, are configured to releasably engage the tubular 200. The wedges 50 may be drawn downward by engagement with the tubular 200 or by driving the piston 48 downward, as described above. The tapered housing 44 is generally prevented from moving radially outward by the body 16, and thus the wedges 50 sliding downward causes the wedges 50 to move inward, toward the tubular 200, until the wedges 50 securely engage the tubular 200. The bails (not shown) coupled to the ears 22, 24 may thus enable the rig (not shown) to carry the weight of the tubular 200. As will be appreciated, the tubular 200 is generally free from engagement with the elevator 12 in the channels 36, 38, 40, 42.

Figure 4:
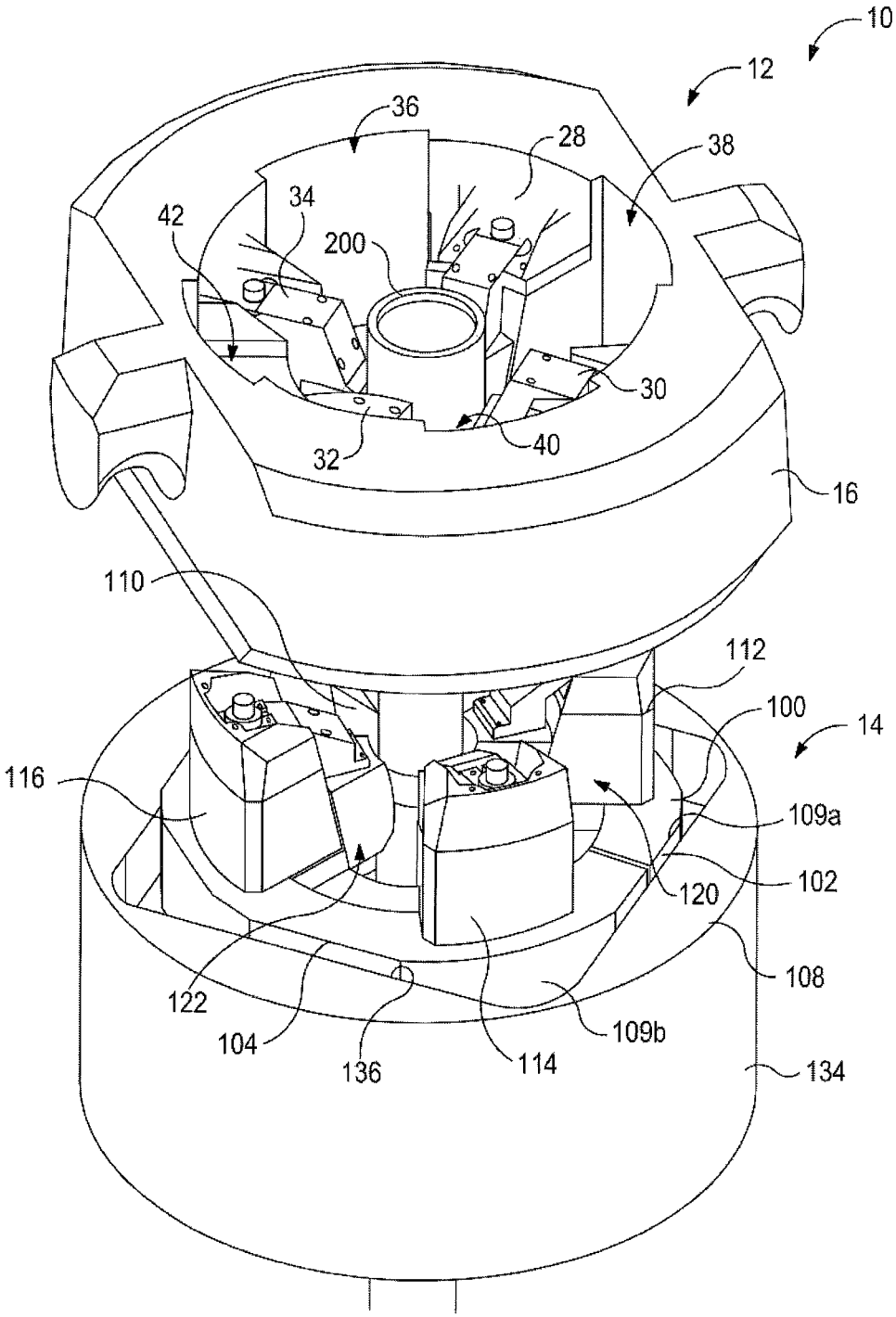
FIG. 4 illustrates a perspective view of the running system of FIG. 1 engaging a tubular, according to an aspect of the disclosure.

FIG. 4 illustrates a perspective view of the running system 10, with the elevator 12 and the spider 14 being moved vertically into close proximity with one another, according to an embodiment described. As the elevator 12 is lowered, the gripping assemblies 28, 30, 32, 34 of the elevator 12 may be angularly aligned with the channels 118, 120, 122, 124 (channels 120 and 122 are viewable in FIG. 4) of the spider 14, while the gripping assemblies 28, 30, 32, 34 engage the tubular 200 and transmit its weight via the body 16 of the elevator 12 to the rig (not shown). During this time, the spider 14 generally does not engage the tubular 200 to bear its weight, although in some instances, it is contemplated that the spider 14 may provide guidance for the lowering of the tubular 200. In at least one specific embodiment, the elevator 12 is lowered toward the spider 14 while engaging an upset (not shown) of the tubular 200, as will be described in greater detail below.

As also illustrated in FIG. 4, the body 100 of the spider 14 is surrounded by the rotary table 134. In one embodiment, the rotary table 134 defines a generally rectangular inner surface 136, with the generally cylindrical body 100 being inscribed therein. The flats 102, 104, 106 (flats 104 and 102 are viewable in FIG. 4) of the shoulder 101 of the body 100 may bear on the inner surface 136. Accordingly, the segments 109*a,b* of the body 100 may be restrained from separating by the rotary table 134, thereby preventing the gripping assemblies 110, 112, 114, 116 of the spider 14 from moving radially-outward. As discussed above, however, it will be appreciated that the body 100 of the spider 14 may, in some embodiments, not be segmented, may be hinged, and/or may include more than two segments.

Figure 5:
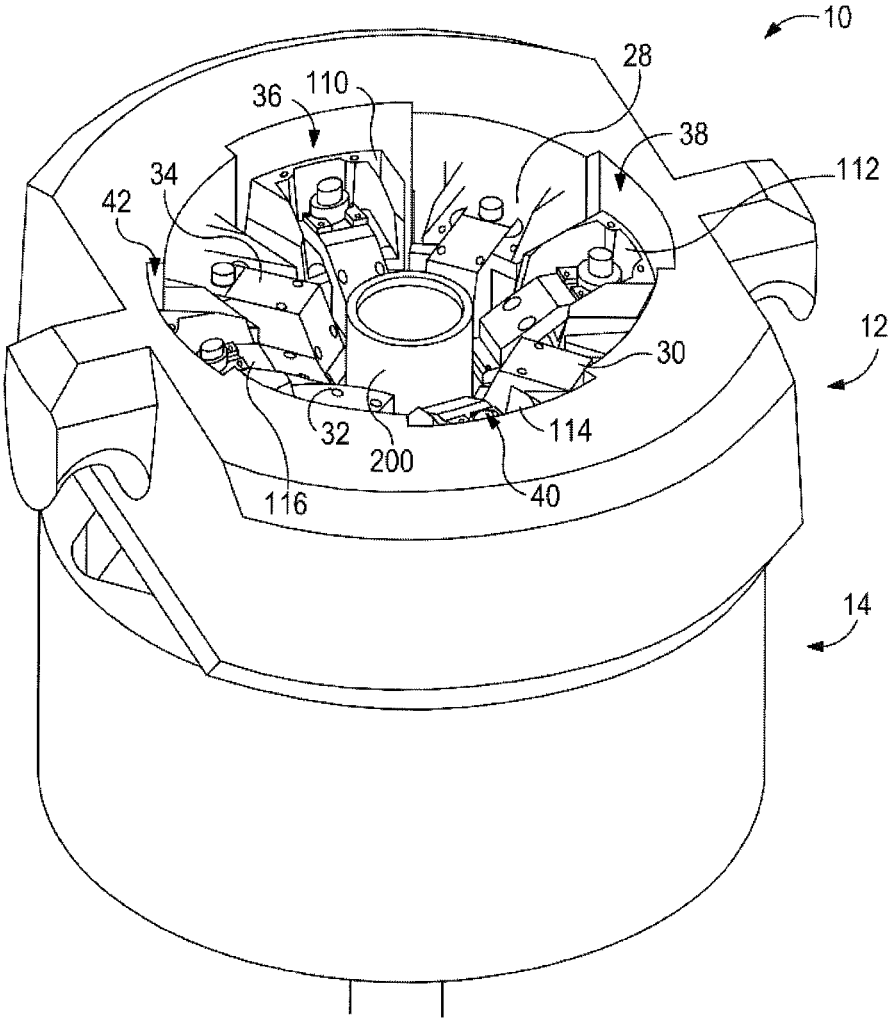
FIG. 5 illustrates a perspective view of the tubular being transferred from the elevator to the spider, according to an aspect of the disclosure.
Figure 6:
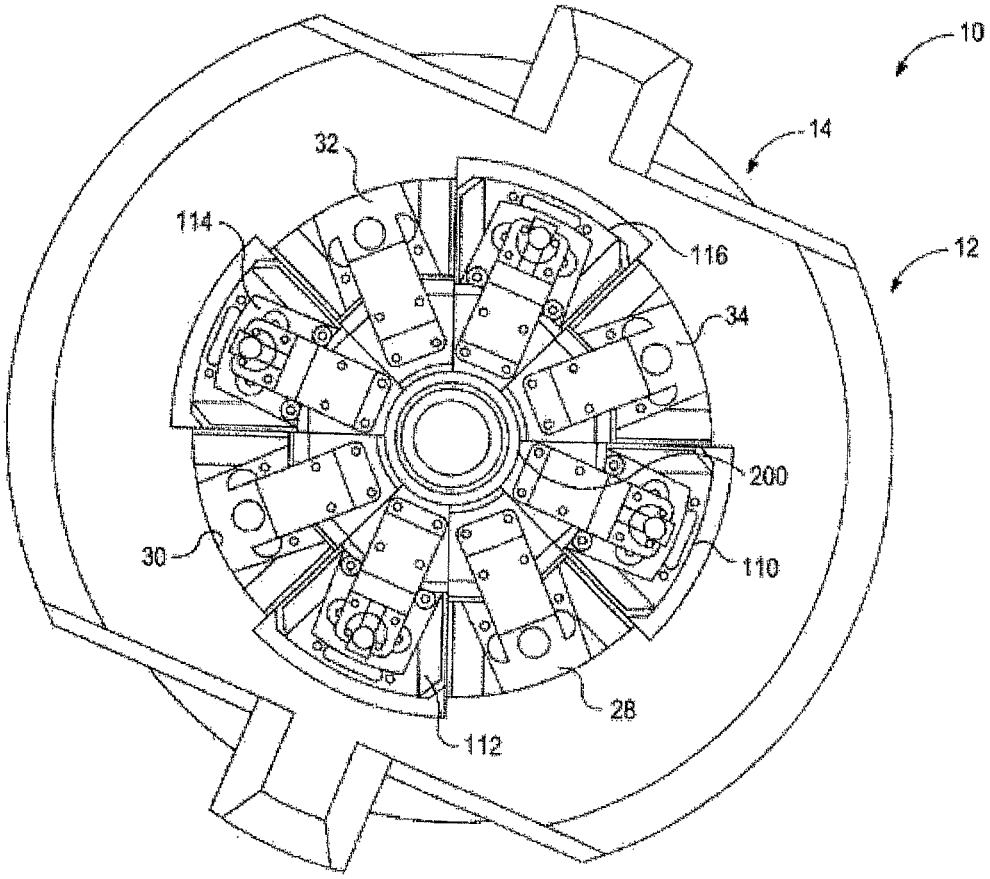
FIG. 6 illustrates a top view of the running system as shown in FIG. 5.

With continuing reference to FIG. 4, FIGS. 5 and 6 illustrate perspective and top views, respectively, of the running system 10, showing the elevator 12 transferring the load of the tubular 200 to the spider 14, according to an embodiment described. The gripping assemblies 110, 112, 114, 116 extend upward, toward the elevator 12 and are sized to slide axially and fit at least partially in the channels 36, 38, 40, 42 of the elevator 12. Correspondingly, the gripping assemblies 28, 30, 32, 34 of the elevator 12 are positioned and sized so as to align with and slide at least partially in the channels 118, 120, 122, 124 of the spider 14 (best shown in FIG. 1). As shown in FIGS. 5 and 6, the elevator 12 is thus received into the spider 14, such that, in an exemplary embodiment, the elevator 12 rests on the landing surface 108 (FIG. 4) of the spider 14. The enmeshed gripping assemblies 28, 30, 32, 34 and 110, 112, 114, 116 of the elevator 12 and the spider 14, respectively, are thus both positioned about the tubular 200 at approximately equal axial locations.

Accordingly, the gripping assemblies 110, 112, 114, 116 of the spider 14 may be engaged when the elevator 12 comes into proximity with, for example lands on, the landing surface 108 (FIG. 4). As such, the gripping assemblies 110, 112, 114, 116 of the spider 14 are at approximately the same axial location on the tubular 200 as are the gripping assemblies 28, 30, 32, 34 of the elevator 12. The gripping assemblies 110, 112, 114, 116 may then engage the tubular 200, for example, the upset (not shown) to which the gripping assemblies 28, 30, 32, 34 of the elevator 12 are also engaged, though at different circumferential locations about the tubular 200. Once the engagement between the spider 14 and the tubular 200 is secured, the gripping assemblies 28, 30, 32, 34 of the elevator 12 may be disengaged. As such, the elevator 12 releases the tubular 200, and the weight of the tubular 200 is transferred seamlessly to the spider 14. To remove the elevator 12 from the tubular 200, the elevator 12 may be raised upwards, may have a hinge (not shown) that can open to allow the elevator 12 to be laterally removed, or may be otherwise configured for removal. As will be appreciated, this enmeshing of the gripping assemblies 28, 30, 32, 34, 110, 112, 114, 116 allows the spider 14 and the elevator 12 to engage a single upset, transfer the load between the two (e.g., from the elevator 12 to the spider 14), and release the elevator 12 so that it may be used to engage another tubular (not shown), to repeat the engaging and lowering process.

Figure 7:
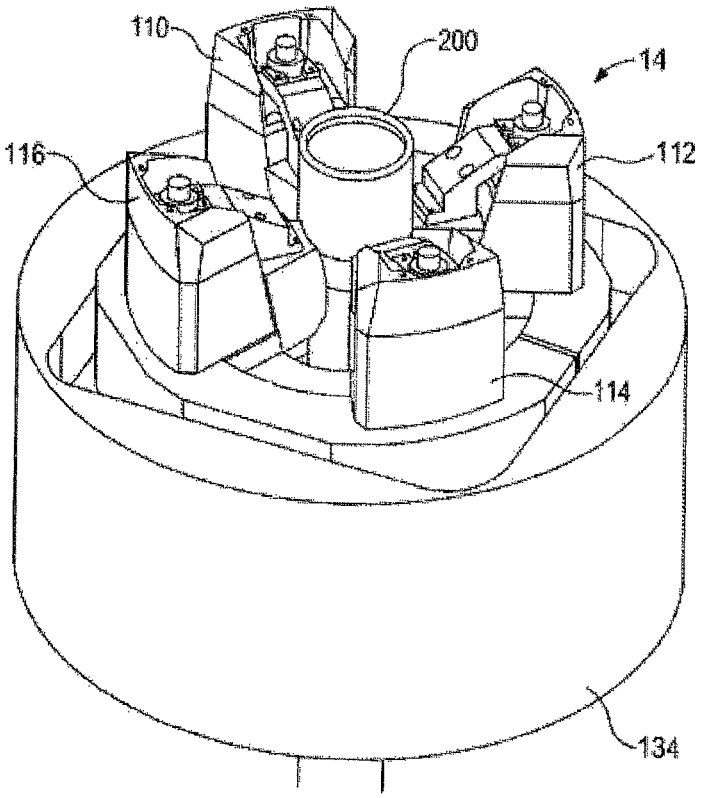
FIG. 7 illustrates a perspective view of the spider engaging the tubular, according to an aspect of the disclosure.
Figure 8:
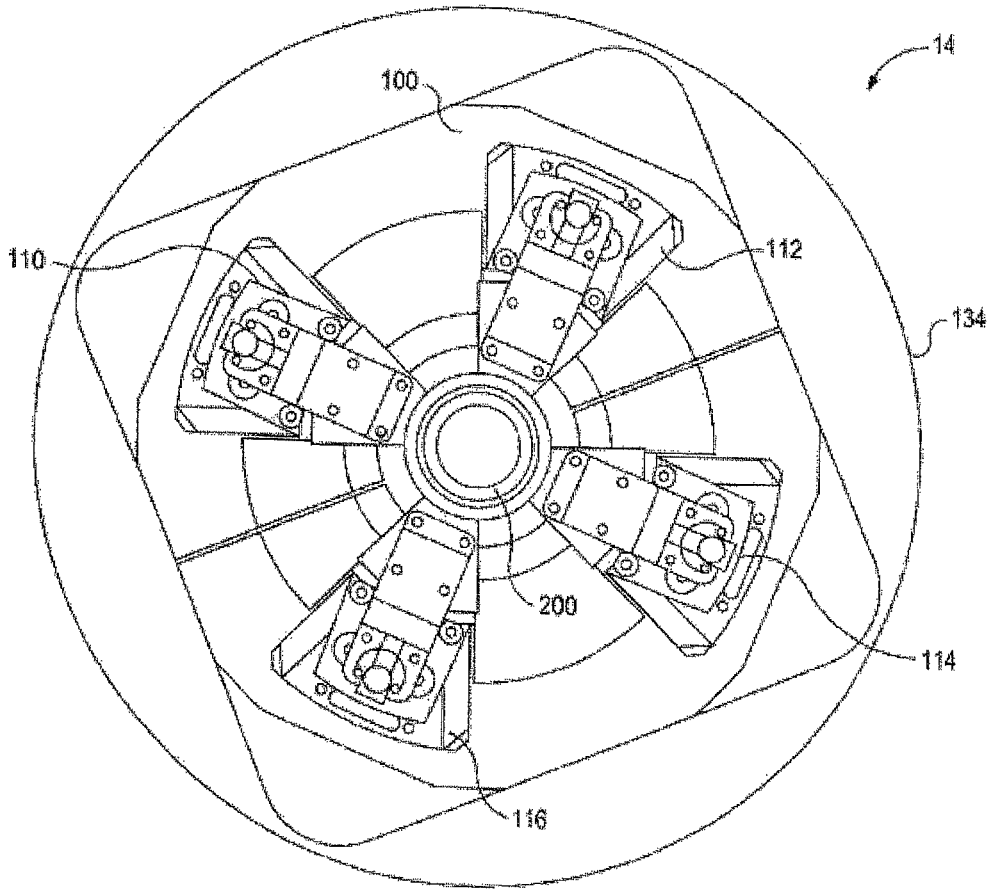
FIG. 8 illustrates a top view of the spider of FIG. 7, according to an aspect of the disclosure.

FIGS. 7 and 8 illustrate perspective and top views, respectively, of the spider 14 engaging the tubular 200, according to an embodiment described. After the upset of the tubular 200 has been lowered onto the spider 14, and the weight of the tubular 200 has been transferred to the spider 14, the elevator 12 (e.g., FIG. 6) may be removed. As such, the gripping assemblies 110, 112, 114, 116 of the spider 14 engage and maintain the position of the tubular 200, while the rotary table 134 maintains the radial position of the body 100, and thus of the gripping assemblies 110, 112, 114, 116.

Referring to FIGS. 1-8, although the gripping assemblies 110, 112, 114, 116 of the spider 14 are illustrated as extending upward for being received into the channels 36, 38, 40, 42 of the elevator 12, while the gripping assemblies 28, 30, 32, 34 are generally disposed within the bore 26 of the elevator 12, it will be appreciated that variations of this arrangement are within the scope of this disclosure. For example, the gripping assemblies 28, 30, 32, 34 may extend downward, such that they are received in the channels 118, 120, 122, 124 of the spider 14. In such embodiments, the gripping assemblies 110, 112, 114, 116 may still extend generally upward from the landing surface 108, may reside partially within the bore 103 and partially extending upward from the landing surface 108, or may extend at least partially, or even entirely, down from the landing surface 108, or from a point in the bore 103 below the landing surface 108.

Moreover, it will be appreciated that either or both of the tubular engagement devices 12, 14 may be movable, without departing from the scope of the disclosure. Furthermore, in various embodiments, the first tubular engagement device 12 may be stationary, while the second tubular engagement device 14 is movable. Additionally, the illustrated views of running system 10 may be flipped, such that the first tubular engagement device 12 is moved upward to the second tubular engagement device 14, or the second tubular engagement device 14 is lowered to the first tubular engagement device 12.

Figure 9:
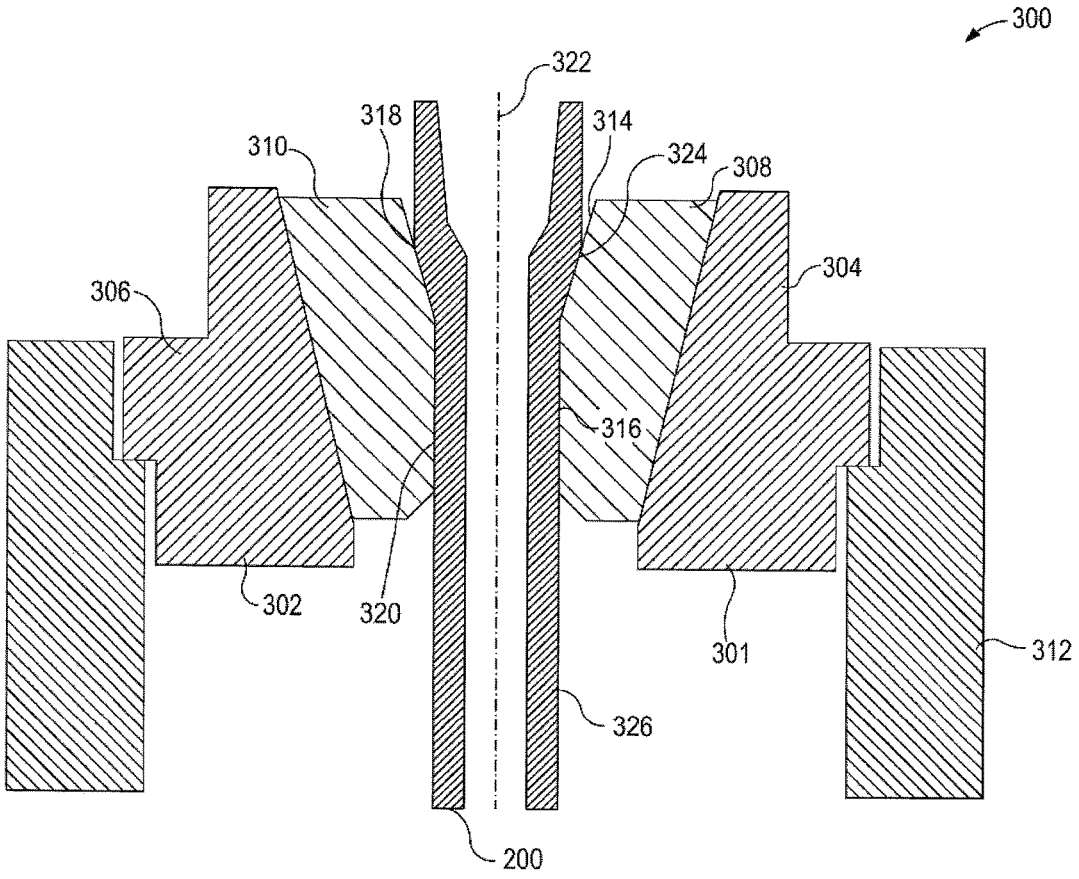
FIG. 9 illustrates a simplified, side, cross-sectional view of a tubular engagement device engaging a tubular, according to an aspect of the disclosure.

Turning now to FIG. 9, there is illustrated a simplified, side, cross-sectional view of a portion of the tubular 200 being engaged by a tubular engagement device 300, according to an embodiment described. The tubular engagement device 300 may be generally representative of the structure and operation of the elevator 12 and/or the spider 14 described above. Accordingly, the tubular engagement device 300 generally includes gripping assemblies 301, 302. Although two gripping assemblies 301, 302 are shown, it will be appreciated that additional gripping assemblies may be employed, for example two additional gripping assemblies, without departing from the scope of this disclosure. The gripping assemblies 301, 302 each generally include a tapered housing 304, 306 and a wedge 308, 310, respectively. The wedges 308, 310 are slidable with respect to the housings 304, 306, respectively, and are reverse tapered with respect thereto. Accordingly, as the wedges 308, 310 are drawn downward, for example, by friction from engagement with the tubular 200 and/or by pneumatics, hydraulics, motors, linkages, or the like, the wedges 308, 310 are pushed inwards into engagement with the tubular 200. The tapered housing 304, 306 supplies the reactionary axial and horizontal force against the wedges 308, 310. As such, the base 312 transfers the weight of the tubular 200, either by resting on a platform (e.g., for a spider), by hanging from the rig via bails (e.g., for an elevator), or in any other suitable manner.

The wedges 308, 310 each define upper and lower interior surfaces 314, 316 and 318, 320, respectively. The upper interior surfaces 314, 318 may be tapered, converging toward a central axis 322, proceeding downwardly. The lower interior surfaces 316, 320 may be generally parallel to the axis 322. In other embodiments, however, the lower interior surfaces 316, 320 may also be tapered, converging toward the central axis 322, proceeding downward. In some embodiments, one, some, or all of the upper and/or lower interior surfaces 314, 316, 318, 320 may be free from teeth or other marking structures; however, in various other embodiments, any of the surfaces 314, 316, 318, 320 may include such teeth or other marking structures (none shown) to facilitate engagement with the tubular 200.

The upper interior surfaces 314, 318 may be shaped to abut and engage an upset 324 of the tubular 200. The upset 324 may be a radial protrusion extending radially outward from a remaining tubular body 326, as shown, but in other embodiments may extend radially inward. In various embodiments, the upset 324 may be disposed on (e.g., fastened, welded, brazed, or otherwise connected to, integral with, or otherwise part of) the tubular 200. The upset 324 may be capable of withstanding greater tensile forces than the tubular body 326 and transmitting such axial forces to the gripping assemblies 301, 302. Accordingly, the upset 324 may represent an area desirable for the gripping assemblies 301, 302 to engage, to avoid slip crushing the tubular 200.

To provide further load distribution, the lower interior surfaces 316, 320 may engage the tubular body 326, as shown. Accordingly, some of the axial load of the tubular 200 weight is transmitted via the radial gripping force applied by the gripping assemblies 301, 302 onto the tubular body 326. By simultaneously engaging the upset 324 with the upper interior surfaces 314, 318, and the tubular body 326 with the lower interior surfaces 316, 320, the gripping assemblies 301, 302, the tubular engagement device 300, and ultimately the rig may be able to support and run the tubular 200, while supporting strings having a greater weight than that which a simple engagement with the upset 324, let alone engagement only with the tubular body 326 by itself, is capable of safely handling.

Figure 10:
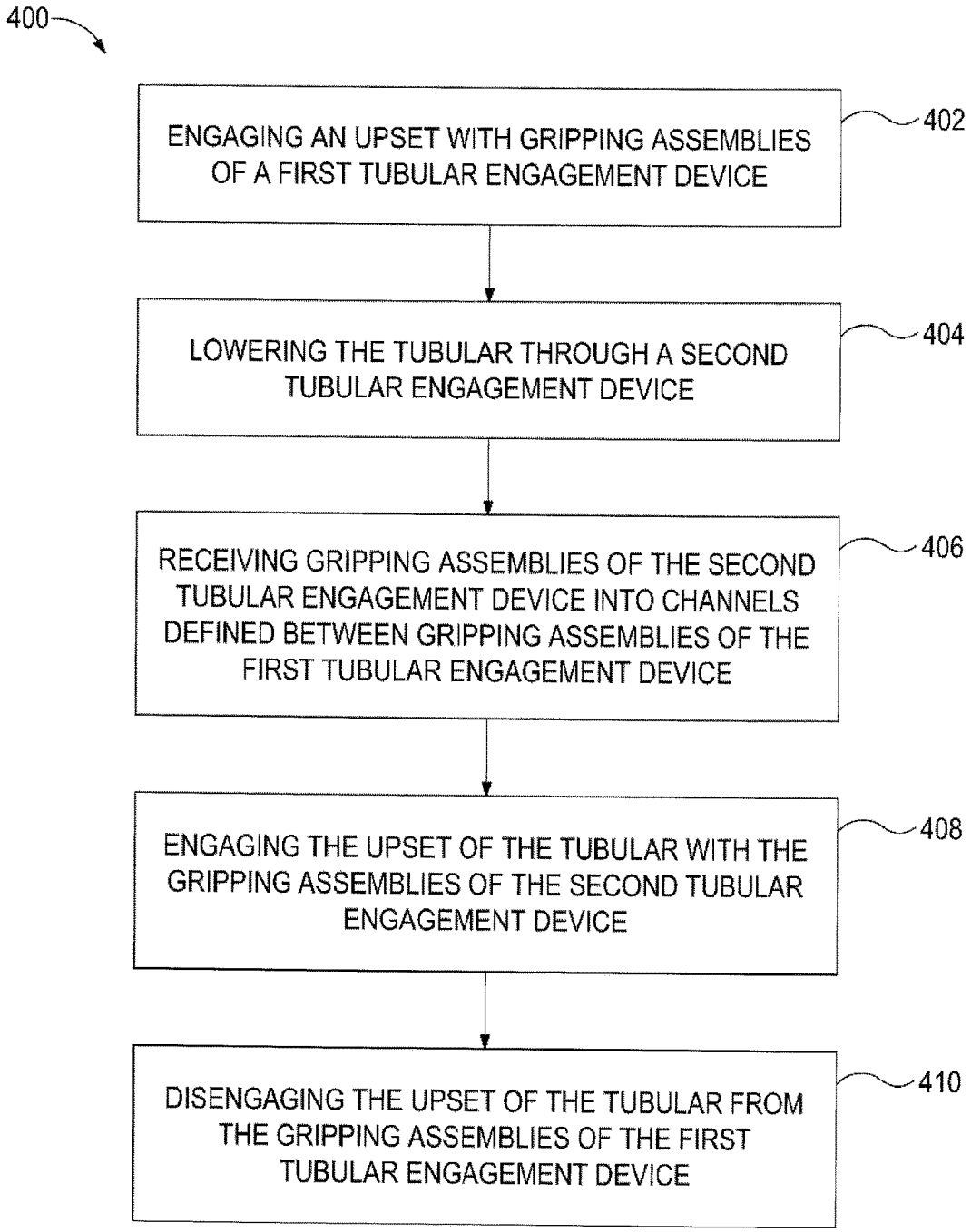
FIG. 10 illustrates a flowchart of an exemplary method for moving a tubular, according to an aspect of the disclosure.

FIG. 10 illustrates a method 400 for lowering a tubular, according to an embodiment described. The method 400 may proceed by operation of the running system 10 and/or the tubular engagement device 300 described above with reference to FIGS. 1-9 and may be best understood with reference thereto. The method 400 includes engaging an upset of the tubular with gripping assemblies of a first tubular engagement device, as at 402. More particularly, in at least one embodiment, such engagement may include simultaneously engaging the upset and a body of the tubular to support a weight of the tubular via engagement with both the upset and the body. The tubular supported by the first tubular engagement device, as at 402, may then be lowered into and made-up to a tubular string, such that the method 400 includes supporting the weight of the string of tubulars with the first engagement device.

The method 400 further includes vertically moving, for example, lowering the tubular through a second tubular engagement device by lowering the first tubular engagement device, as at 404. The method 400 may also include receiving gripping assemblies of the second tubular engagement device into channels defined between gripping assemblies of the first tubular engagement device, as at 406. The method 400 may also include engaging the upset of the tubular with the gripping assemblies of the second tubular engagement device, as at 408. The method 400 may further include disengaging the upset of the tubular from the gripping assemblies of the first tubular engagement device, such that the upset is supported by the second tubular engagement device, as at 410.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A tubular running system, comprising:

an elevator suspended from a rig and including a body defining a bore to receive a tubular and wedges defining channels therebetween, the wedges being configured to engage the tubular; and a spider including a body defining a bore to receive the tubular and wedges defining channels therebetween, the wedges of the spider being configured to engage the tubular, wherein the wedges of the elevator are disposed at least partially in the channels of the spider, and the wedges of the spider are disposed at least partially in the channels of the elevator, and wherein the elevator and the spider are configured to be enmeshed together to engage the tubular simultaneously.

2. The system of claim 1, the spider further comprising a rotary table having an opening formed therein defining an inner surface of the rotary table, wherein the body of the spider is disposed within the opening formed in the rotary table such that the body of the spider is surrounded by the rotary table.

3. The system of claim 1, wherein the body of the spider is substantially cylindrical in shape.

4. The system of claim 2, wherein a first segment and a second segment of the body of the spider are restrained from separating by the rotary table, thereby preventing the wedges of the spider from moving radially-outward.

5. The system of claim 2, wherein the rotary table comprises a landing surface configured to engage with a bottom surface of the elevator.

6. An apparatus comprising:

a first tubular engagement device suspended from a rig and including a plurality of first gripping assemblies spaced apart and defining first channels therebetween, the plurality of first gripping assemblies configured to engage at least an upset of a tubular to support the tubular; and a second tubular engagement device including a plurality of second gripping assemblies spaced circumferentially apart and defining second channels therebetween, the plurality of second gripping assemblies configured to engage at least the upset of the tubular to support the tubular, wherein the second tubular engagement device is configured to engage the upset while the first tubular engagement device is also in engagement with the upset;

wherein the plurality of first gripping assemblies of the first tubular engagement device are disposed at least partially in the second channels of the second tubular engagement device, and the plurality of second gripping assemblies of the second tubular engagement device are disposed at least partially in the first channels of the first tubular engagement device, and wherein the first tubular engagement device and the second tubular engagement device are configured to be enmeshed together to engage the tubular simultaneously.

7. The apparatus of claim 6, the second tubular engagement device further comprising a rotary table having an opening formed therein defining an inner surface of the rotary table, wherein a body of the second tubular engagement device is disposed within the opening formed in the rotary table such that the body of the second tubular engagement device is surrounded by the rotary table.

8. The apparatus of claim 6, wherein the body of the second tubular engagement device is substantially cylindrical in shape.

9. The apparatus of claim 7, wherein a first segment and a second segment of the body of the second tubular engagement device are restrained from separating by the rotary table, thereby preventing the plurality of second gripping assemblies of the second tubular engagement device from moving radially-outward.

10. The apparatus of claim 7, wherein the rotary table comprises a landing surface configured to engage with a bottom surface of the first tubular engagement device.

11. A method of running a tubular, comprising:

engaging a tubular with a plurality of first gripping assemblies of an elevator;

lowering the elevator onto a spider;

engaging the tubular with a plurality of second gripping assemblies of the spider while the plurality of first gripping assemblies of the elevator are still gripping the tubular; and enmeshing the elevator and the spider together.

12. The method of claim 11, wherein the enmeshing of the elevator and spider comprises: disposing the plurality of first gripping assemblies of the elevator into second channels of the spider and disposing the plurality of second gripping assemblies of the spider into first channels of the elevator.

13. The method of claim 11, further comprising restraining the plurality of second gripping assemblies of the spider from moving radially-outward with a rotary table disposed around a body of the spider.

14. A method of running a tubular, comprising:

engaging an upset of the tubular with an elevator;

engaging the upset of the tubular with a spider while still engaging the upset with the elevator;

wherein engaging the upset of the tubular with the elevator comprises drawing wedges downward and inward;

wherein engaging the upset of the tubular with the spider comprises extending wedges upward and inward; and enmeshing the elevator with the spider.

15. A method of claim 14, wherein the enmeshing of the elevator and spider comprises: disposing the wedges of the elevator into channels of the spider and disposing the wedges of the spider into channels of the elevator.

16. The method of claim 14, further comprising restraining the wedges of the spider from moving radially-outward with a rotary table disposed around a body of the spider.

* * * * *